US008863431B2

(12) United States Patent
Williams et al.

(10) Patent No.: US 8,863,431 B2
(45) Date of Patent: Oct. 21, 2014

(54) UNIVERSAL PATCH ASSEMBLY FOR CLEANING THE BORES OF WEAPONS

(71) Applicant: The Otis Patent Trust, Lyons Falls, NY (US)

(72) Inventors: Nicholas Williams, Naples, FL (US); James R. Brooker, Constantia, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 0 days.

(21) Appl. No.: 13/797,158

(22) Filed: Mar. 12, 2013

(65) Prior Publication Data

US 2013/0269234 A1 Oct. 17, 2013

Related U.S. Application Data

(60) Provisional application No. 61/625,391, filed on Apr. 17, 2012, provisional application No. 61/725,235, filed on Nov. 12, 2012.

(51) Int. Cl.
*F41A 31/00* (2006.01)
*F41A 29/02* (2006.01)

(52) U.S. Cl.
CPC ..... *F41A 29/02* (2013.01)
USPC ..... 42/95; 15/104.18; 15/104.05

(58) Field of Classification Search
USPC ..... 42/95; 15/104.18, 104.05
See application file for complete search history.

(56) References Cited

U.S. PATENT DOCUMENTS

| | | | | | |
|---|---|---|---|---|---|
| 43,573 | A | * | 7/1864 | Crane | 15/104.18 |
| 45,027 | A | * | 11/1864 | Crane | 15/104.18 |
| 46,140 | A | * | 1/1865 | Pratt | 15/104.18 |
| 47,260 | A | * | 4/1865 | Pratt | 15/104.18 |
| 49,848 | A | * | 9/1865 | Berdan | 15/104.165 |
| 209,276 | A | * | 10/1878 | Longden | 15/104.16 |
| 211,555 | A | * | 1/1879 | Comstock | 15/104.18 |
| 214,484 | A | * | 4/1879 | Brown | 15/104.18 |
| 232,406 | A | * | 9/1880 | Lamb | 15/104.068 |
| 289,132 | A | * | 11/1883 | Petmecky | 15/104.18 |
| 350,847 | A | * | 10/1886 | Sherman | 15/104.18 |
| 358,304 | A | * | 2/1887 | Simpson | 15/104.18 |
| 379,564 | A | * | 3/1888 | Davison | 15/104.18 |
| 388,133 | A | * | 8/1888 | Hartness | 15/104.17 |
| 399,452 | A | * | 3/1889 | Tomlinson | 15/104.19 |

(Continued)

OTHER PUBLICATIONS

ISA/US, International Search Report and Written Opinion of the International Searching Authority for Corresponding International Application No. PCT/US2013/036589 (9 pgs).

*Primary Examiner* — Michelle R Clement
(74) *Attorney, Agent, or Firm* — Harris Beach PLLC

(57) ABSTRACT

A universal gun cleaning patch assembly comprising a support frame having a hub and hub bore, a plurality of resiliently deformable legs, and a swab. The assembly is radially compressible to effectively wipe the bores of weapons having a wide range of bore diameters. The swab material is preferably made integral with the support frame and may include natural or synthetic fibers and/or laminates of natural and/or synthetic fibers and a metal or plastic mesh embedded in a fabric to effectively scrub the inner bore of the firearm and remove gunpowder residues and excess solvents or oils during the cleaning process. The hub bore may sized to be self-tapping on male threads of a cable or rod that is pulled and/or pushed through the bore, or the bore may be tapered and include a plurality of deformable fingers to received a quick-disconnect stem.

20 Claims, 5 Drawing Sheets

(56) References Cited

U.S. PATENT DOCUMENTS

| | | | | | |
|---|---|---|---|---|---|
| 405,297 | A | * | 6/1889 | Bailey | 15/104.16 |
| 450,323 | A | * | 4/1891 | Tomlinson | 15/104.19 |
| 453,316 | A | * | 6/1891 | Moffat | 15/212 |
| 460,986 | A | * | 10/1891 | Odell | 15/104.18 |
| 481,858 | A | * | 8/1892 | Ferris | 15/104.18 |
| 596,490 | A | * | 1/1898 | Edwards | 403/353 |
| 614,191 | A | * | 11/1898 | Weills | 15/104.165 |
| 699,289 | A | * | 5/1902 | Craddick | 15/104.068 |
| 705,396 | A | * | 7/1902 | Garrison | 15/104.18 |
| 709,557 | A | * | 9/1902 | Pugh | 15/104.19 |
| 713,754 | A | * | 11/1902 | Durston | 15/104.19 |
| 731,190 | A | * | 6/1903 | Kuhlman | 15/104.068 |
| 753,189 | A | * | 2/1904 | Buckelew | 15/104.18 |
| 754,854 | A | * | 3/1904 | Davis | 15/104.16 |
| 801,738 | A | * | 10/1905 | Moos | 15/104.16 |
| 867,098 | A | * | 9/1907 | Bigelow | 15/104.18 |
| 876,276 | A | * | 1/1908 | Landes | 15/104.18 |
| 990,977 | A | * | 5/1911 | Griffith | 15/104.18 |
| 1,015,915 | A | * | 1/1912 | Strickler | 15/104.18 |
| 1,174,220 | A | * | 3/1916 | Zilliox | 15/104.18 |
| 1,384,305 | A | * | 7/1921 | Meador et al. | 166/141 |
| 1,435,647 | A | * | 11/1922 | McCanna | 15/104.18 |
| 1,745,575 | A | * | 2/1930 | Hooker | 15/104.165 |
| 1,786,520 | A | * | 12/1930 | Darling | 15/104.19 |
| 3,064,294 | A | | 11/1962 | Stocking | |
| 3,480,982 | A | | 12/1969 | Saunders | |
| 3,710,411 | A | * | 1/1973 | Murguiondo | 15/104.16 |
| 3,716,884 | A | * | 2/1973 | Lavins | 15/104.16 |
| 4,178,649 | A | * | 12/1979 | Kouse et al. | 15/104.061 |
| 4,222,142 | A | * | 9/1980 | DiProspero | 15/104.165 |
| 4,503,578 | A | * | 3/1985 | McIntyre | 15/104.165 |
| 4,698,932 | A | * | 10/1987 | Schneider | 42/95 |
| 4,962,607 | A | * | 10/1990 | Baldwin | 42/95 |
| 5,337,505 | A | | 8/1994 | Brown et al. | |
| 6,085,376 | A | * | 7/2000 | Antal et al. | 15/104.061 |
| 7,454,812 | B1 | * | 11/2008 | Lyle | 15/104.05 |
| 8,051,523 | B1 | * | 11/2011 | Franzino | 15/104.061 |
| 8,250,800 | B1 | * | 8/2012 | Johnson | 42/95 |
| 8,448,370 | B2 | * | 5/2013 | Williams | 42/95 |
| 2006/0236584 | A1 | | 10/2006 | Williams | |
| 2011/0209379 | A1 | * | 9/2011 | Williams | 42/95 |
| 2012/0042461 | A1 | * | 2/2012 | Antal et al. | 15/104.05 |
| 2013/0091753 | A1 | * | 4/2013 | Rogers et al. | 42/95 |

* cited by examiner

UNIVERSAL PATCH ASSEMBLY FOR CLEANING THE BORES OF WEAPONS

RELATIONSHIP TO OTHER APPLICATIONS AND PATENTS

The present invention draws priority from and incorporates by reference in its entirety, pending U.S. Provisional Patent Application, Ser. No. 61/625,391, filed Apr. 17, 2012; and pending U.S. Provisional Patent Application, Ser. No. 61/725,235, filed Nov. 12, 2012.

FIELD OF THE INVENTION

The present invention relates to apparatus and methods for cleaning the bore of a firearm such as a rifle; more particularly to systems employing a resilient swab of material that is pulled or pushed through the bore; and most particularly to a universal gun cleaning patch assembly comprising a support frame having a center attachment bore and a plurality of legs formed preferably of a resilient plastic such that a fabric swab preferably integral with the legs is radially compressible or reducible in working diameter as needed to effectively wipe a wide range of firearms having bores of differing diameters.

BACKGROUND OF THE INVENTION

It is well known in the prior art of firearm maintenance to clean the bore of a barrel of an explosive-fired weapon periodically to remove undesirable residues of gunpowder, copper, and/or lead that can corrode the bore or otherwise impede operation of the firearm. Common firearms used in the military, law enforcement, hunting and sport shooting include various types of pistols, handguns, shotguns, bolt action and semi-automatic rifles, assault rifles, machine guns, and grenade launchers, referred to herein collectively as "firearms." Typically, a patch or swab of flexible material such as a cloth is inserted into a slotted tip or folded over a tip of a plug having a fixed diameter designed to apply to a relatively narrow range of weapon calibers. See, e.g., U.S. Pat. No. 4,716,673 (FIGS. 8*a*-8*e*), and U.S. Pat. No. 7,356,961 (FIGS. 1 and 1*a*). Because of the varying diameters of the bores of barrels on different types of weapons, a universal kit comprising a plurality of sizes of tips or plugs for supporting a swab is required to engage and clean the range of bores. Examples of such prior art kits are Shotgun Cleaning System SKU No. FG-410 BX and Deluxe Pistol/Rifle Cleaning System SKU No. FG-610 BX, both available from Otis Technology, Lyons Falls, N.Y., USA.

BRIEF DESCRIPTION OF THE INVENTION

In view of the foregoing, there is a need in the art for a one-piece gun cleaning patch assembly that is self-adaptable to clean a wide range of bore diameters.

It is therefore a principal object of the invention to be able to clean the bores of various weapons having a wide range of differing bore diameters, using a single, preferably universal configuration of a gun cleaning patch assembly.

According to one aspect, the invention features a gun cleaning patch assembly comprises a support frame having a hub including a center attachment bore and a plurality of generally radially extending legs formed of a resilient plastic such that the patch may be radially compressed or reduced in diameter by insertion into the bore of a barrel of a firearm to effectively clean the bores of firearms having a wide range of differing bore diameters when forced through the bore. A circular piece of swab material, also referred to herein as "fabric", is formed, bonded, fused, glued, affixed, or otherwise made integral with the support frame, creating the patch assembly. The material may include natural or synthetic fibers and/or laminates of natural and/or synthetic fibers and a metal or plastic threads or mesh embedded in or woven into a fabric to effectively scrub the inner bore of the firearm, and apply, absorb, and remove excess solvent, lubricants or oils during the cleaning process.

According to another aspect, the invention features a gun cleaning patch assembly for cleaning the internal bore of a barrel of a firearm, comprising a support frame including a hub having a longitudinal axis and adapted to engage an end of an elongated member, such as a rigid rod or flexible cable, and a plurality of legs extending outward from said hub, said legs being resiliently flexible in a direction parallel to said longitudinal axis; and a swab affixed to said support frame.

In yet another aspect, the center attachment bore may adapted and configured to be self-tapping on male threads of a threaded fitting of a cable or rod that that may be pulled and/or pushed through the bore. In yet another aspect, the center attachment bore may have complementary threads to a male or female threaded fitting connected to the end of a cable or rod.

In yet another aspect, the attachment bore in the hub may be surrounded by a plurality of axially-extending deformable fingers for engaging a stem of a cleaning cable or rod. One such stem is disclosed in U.S. Patent Application Publication No. 2011/0209379, owned by the common assignee of this application, the disclosure of which is herein incorporated by reference in its entirety.

In yet another aspect, the generally radially-extending legs of the support frame may be relatively straight and radially oriented. In yet another aspect, the legs may spiral radially outwardly from the hub or otherwise curved. The legs are formed to be resiliently deformable axially in the barrel to cause the attached fabric patch to be urged firmly against the internal bore when the assembly is passed through the bore across an extensive range of bore diameters for common firearms. Alternatively, there may be a few scaled embodiments of the gun cleaning patch assembly that cover a portion of the range of bore diameters, for example, one assembly that is adapted and configured to clean the barrels of .22 caliber pistols and rifles through .45 caliber handguns, and a second larger assembly to clean the barrels of shotguns.

In yet another aspect, the invention features a method for cleaning the barrel of a firearm, comprising the steps of providing a gun cleaning patch assembly having a support frame including a hub, a plurality of legs extending outward from said hub and resiliently deformable in a direction parallel to an axis of said barrel, and a swab permanently attached to said support frame; attaching said gun cleaning patch assembly to a first end of an elongated member; passing a second end of said elongated through said barrel; drawing said gun cleaning patch assembly into said barrel wherein said plurality of radial legs and said swab are folded in an axial direction of said barrel; and drawing said first end and said folded universal gun cleaning patch assembly through said barrel.

In yet another aspect, the method of cleaning the barrel of a firearm further includes providing a plurality of longitudinal fingers on the hub that deflect radially inward to engage the stem of a fitting at the first end of an elongated member during the insertion and passing of the assembly through a barrel.

DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
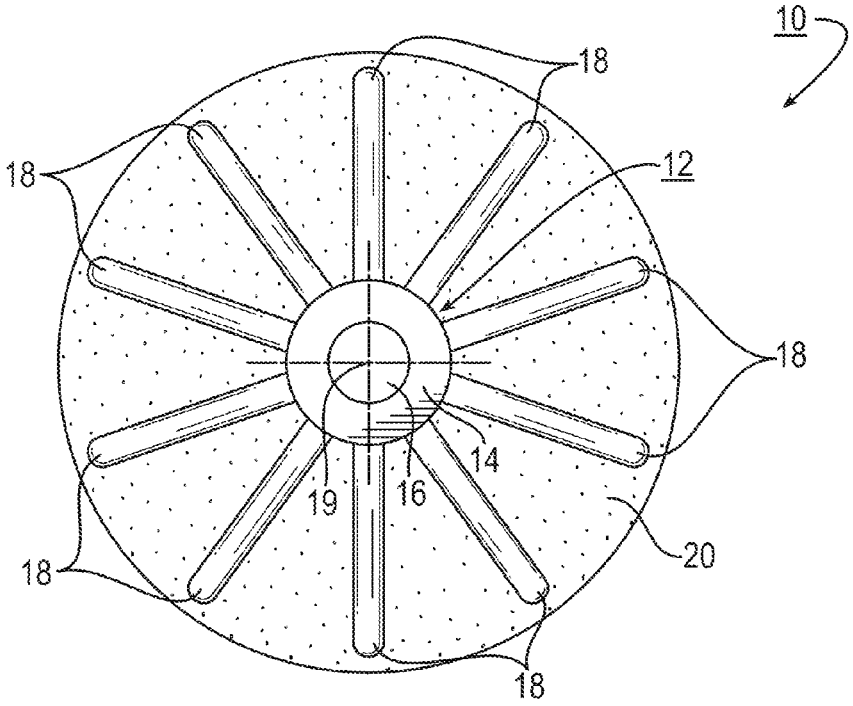
FIG. 1 is a plan view of an exemplary embodiment of a universal gun cleaning patch assembly in accordance with the present invention.

Referring to FIGS. 1 through 4, a first embodiment of a gun cleaning patch assembly 10 in accordance with the present invention comprises a support frame 12 having a hub 14 including a center attachment bore 16, a plurality of generally radial legs 18, preferably eight, and preferably formed of a resilient plastic, and a longitudinal axis 19. A presently preferred plastic for forming support frame 12 is polyamide otherwise known as nylon. In another embodiment, the forming support frame is comprised of Santoprene thermoplastic elastopolymer available from ExxonMobil Chemical Corp., Houston, Tex., USA. A cleaning swab 20 is bonded to frame 12. Cleaning swab 20 comprises a generally circular piece of fabric, which is formed, bonded, fused, glued, affixed, or otherwise made integral with the support frame. The swab material or fabric may include natural or synthetic fibers and/or laminates of natural and/or synthetic fibers and a metal or plastic threads or mesh embedded in or woven into a fabric. The fabric is preferably sufficiently absorbent to retain and apply cleaning solvent, lubricant or corrosion resistant fluids to the internal bore, as well as remove excess solvent, lubricants or oils during the cleaning process. The fabric may also be formed to incorporate one or more relatively stiffer fibers, threads or wire to effectively scrub the inner bore of the firearm as it is passed through the barrel.

In one embodiment, hub 14 comprises a plurality of external longitudinal ribs 22 arrayed individually against each of legs 18. Ribs 22 assist in the handling of the assembly. In alternative embodiments, the axial ribs may be replaced with radial ribs, knurling, surface texturing and combinations thereof.

Legs 18, with cleaning swab 20 bonded or otherwise affixed thereto, are flexibly resilient in a direction longitudinal of hub 14 such that universal gun cleaning patch assembly 10 may be inserted into any of a wide diameter range of weapon bores wherein legs 18 and swab 20 will fold in the axial direction of hub 14 sufficiently to permit gun cleaning patch assembly 10 to be inserted axially into the bore of any of such weapons. See FIG. 8. In such condition, legs 18 urge cleaning swab 20 into compressive contact with the interior walls of the barrel. The greater the number of radial legs 18, the higher the probability the weapon bore will be satisfactorily cleaned across the entire circumference. In one exemplary embodiment, a minimum of six radial legs 18 are suitable for the task. In the illustrated embodiment of FIGS. 1 through 4, eight radial legs 18 are depicted. More than ten radial legs 18 may also provide adequate cleaning.

Center attachment bore 16 may be female threaded for attachment to a male threaded end on an elongated member 40 or cleaning tool, such as a rod or cable. In an alternative embodiment, the hub may be fitted with male threading that engages the internal, female threads of another fitting 42. Persons skilled in the art will understand that a number of fastening methods and structures between the hub and a rod or cable may be employed including snap engagement and press fitting. However, preferably bore 16 is formed having a diameter such that hub 14 can be deformably self-threaded onto such a male threaded end.

Figure 2:
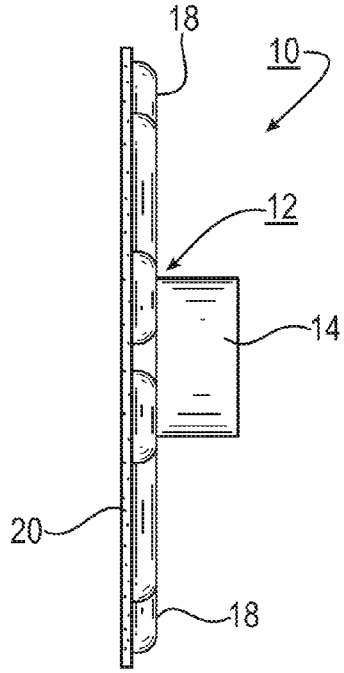
FIG. 2 is a side view of the patch assembly shown in FIG. 1.
Figure 3:
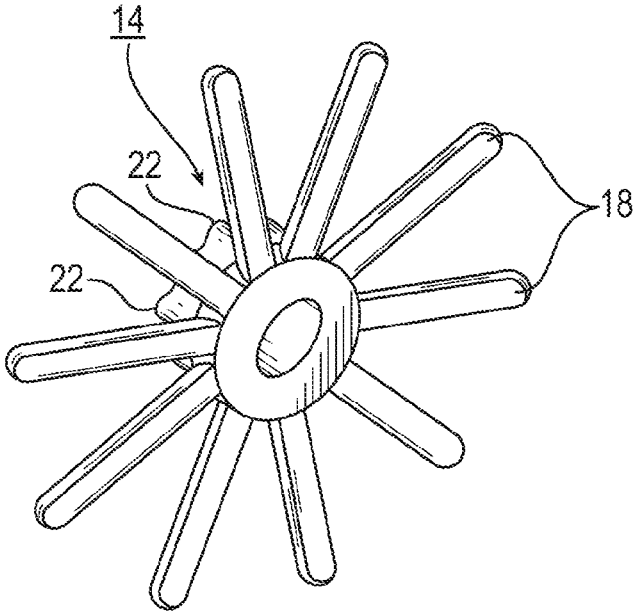
FIG. 3 is an isometric view of a support frame in accordance with the first embodiment having a center attachment bore and a plurality of generally radially extending legs.
Figure 4:
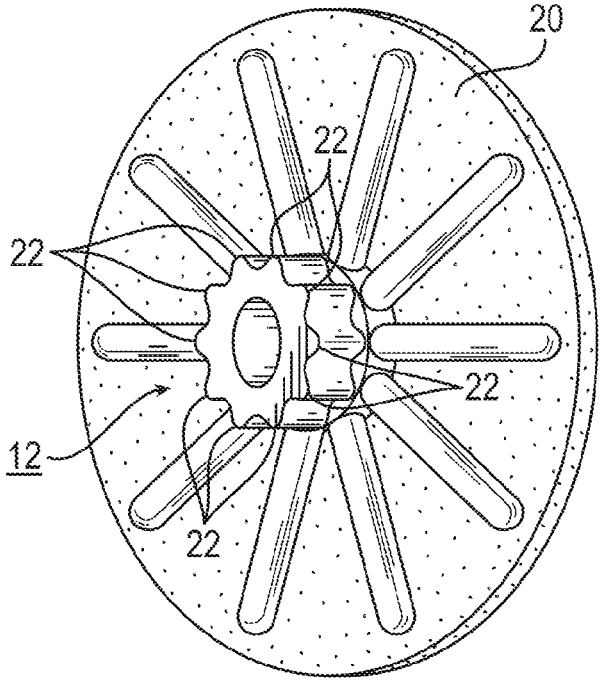
FIG. 4 is an isometric view of the universal gun cleaning patch assembly shown in FIG. 1.

In a presently preferred embodiment, hub 14 is about 0.200 inches in diameter and about 0.130 inches long; bore 16 is about 0.100 inches in diameter; each rib 18 is about 0.30 inches thick and 0.040 inches wide; and the overall diameter of support frame 12 is about 0.700 inches. Preferably, the diameter of cleaning patch 20 is slightly larger than the diameter of support frame 12, as shown in FIGS. 2 and 4.

Figure 5:
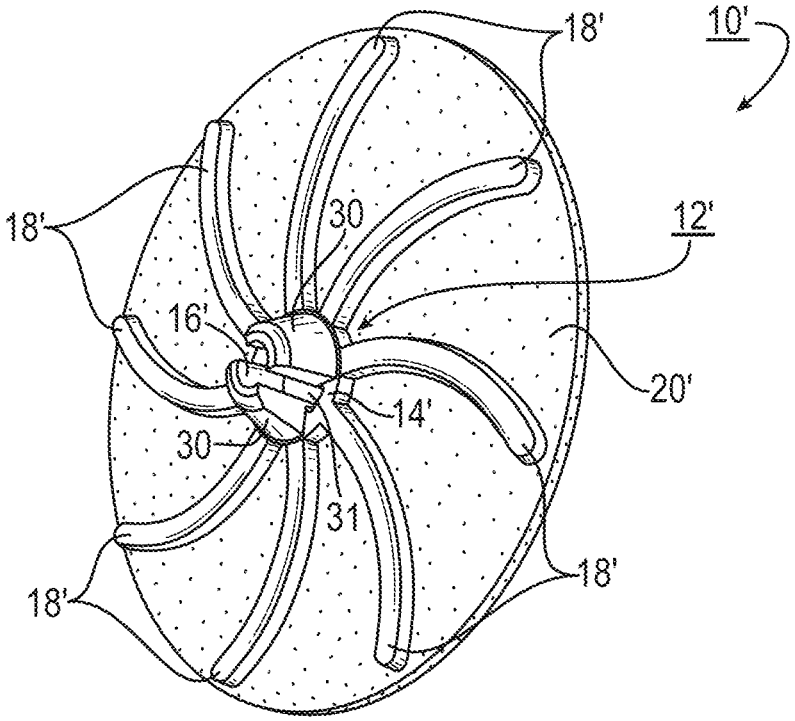
FIG. 5 is an isometric view of the front side of a second exemplary embodiment of a gun cleaning patch assembly in accordance with the present invention.
Figure 6:
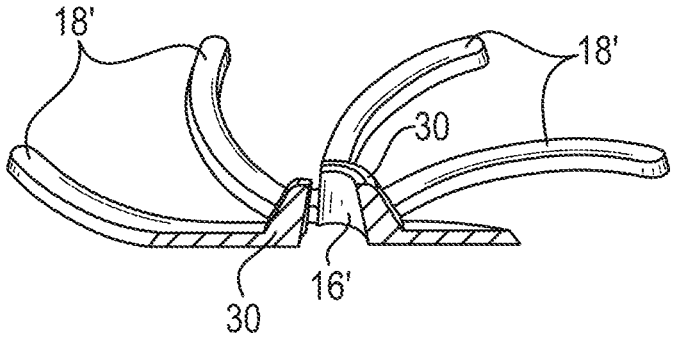
FIG. 6 an isometric view in cutaway of the support frame of the second exemplary embodiment of the invention, showing a tapered central bore.
Figure 7:
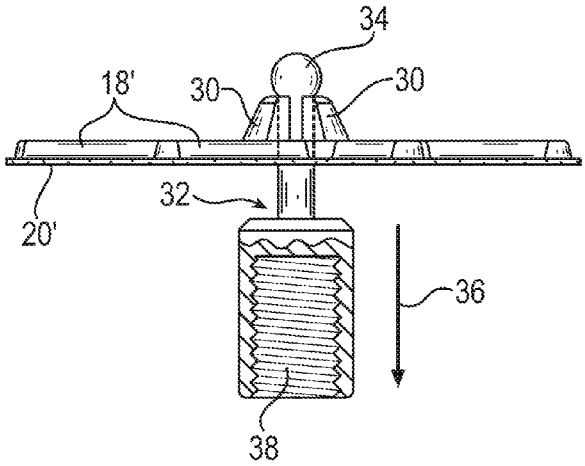
FIG. 7 is a side view of the second exemplary embodiment showing a quick-connect stem of a cleaning cable or rod installed in the tapered center attachment bore and retained by the axially-extending deformable fingers.

Referring now to FIGS. 5 through 7, a second exemplary embodiment 10' of a universal gun cleaning patch assembly is generally similar to first exemplary embodiment 10, comprising a support frame 12' having a hub 14' including a tapered center attachment bore 16', a plurality of legs 18', preferably eight, extending outward from hub 14' in a flat spiral. A cleaning swab 20' is bonded or otherwise affixed to frame 12'. Hub 14' comprises a plurality of external, deformable, longitudinal fingers 30, preferably two, separated by longitudinal slits 31 in the hub, arrayed symmetrically about the smaller-diameter end of tapered center attachment bore 16'.

Figure 8:
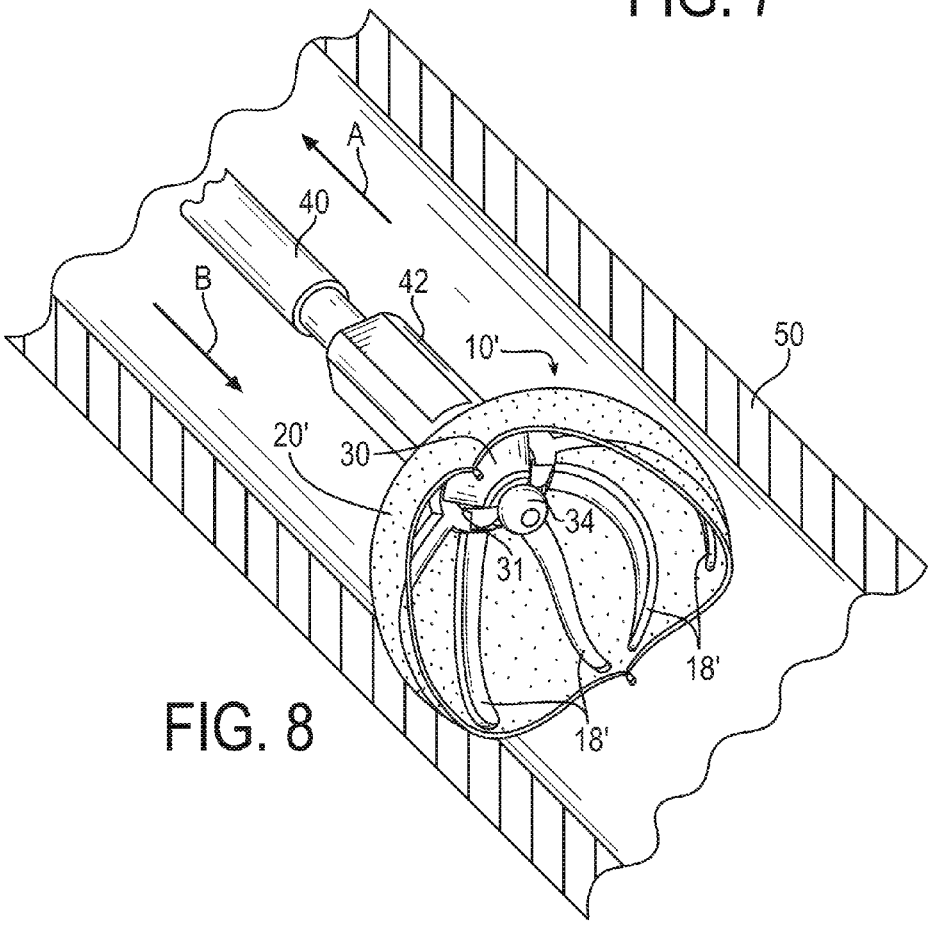
FIG. 8 is a isometric cut-away view of an exemplary embodiment of a gun cleaning patch assembly deployed within the bore of a barrel of a firearm.
Figure 9:
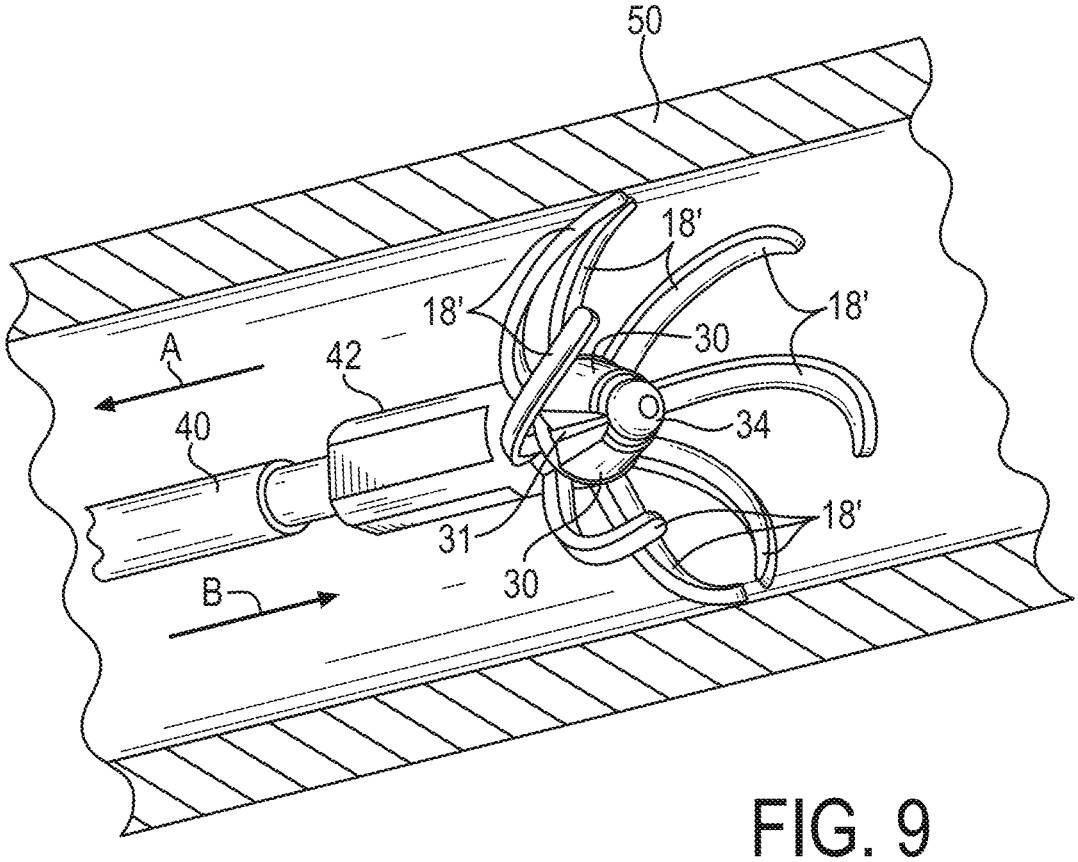
FIG. 9 is a isometric cut-away view of an exemplary embodiment of the support frame without the affixed swab as it would be deployed within the bore of a barrel of a firearm to depict the axial deflection of the radially extended legs of the frame during use.

Referring now to FIGS. 8 and 9, gun cleaning patch assembly 10' is shown deployed within the barrel of a firearm. In FIG. 9, the swab is not shown in order to more clearly depict the operation of the support frame 12' including hub 14' having fingers 30 further defining slots 31, and extended legs 18'. Gun cleaning patch assembly is connected to fitting 42 at one end of an elongated cleaning rod or cable 40 and pulled through the barrel in the direction of arrow A. Legs 18', with cleaning swab 20' bonded thereto, are flexibly resilient in a direction longitudinal of hub 14' (as shown by arrows B in FIGS. 8 and 9) and the direction of deflection (arrow B) is in the opposite motion of the elongated cleaning rod or cable 40 moving through the barrel 50 (arrow A). In this manner, universal gun cleaning patch assembly 10' may be inserted into any of a wide diameter range of weapon bores as shown in FIG. 8 wherein legs 18' and swab 20' will fold in the axial direction (see arrows B) of hub 14' sufficiently to permit gun cleaning patch assembly 10' to be inserted axially into the bore of any of such firearms. In such condition, legs 18' urge cleaning swab 20' into compressive contact with the walls of the firearm bore.

In a presently preferred method for forming universal gun cleaning patch assembly 10, 10', in a conventional injection molding machine (not shown) a fresh swab 20, 20' is placed onto the face of an injection mold for support frame 12, 12' such that swab 20, 20' completely covers the mold face. The machine is loaded with a suitable thermoplastic elastopolymer and the machine cycle is started. Molten elastopolymer flowing into the mold cavity permeates the patch material, forming a bond between swab material 20, 20' and molded support frame 12, 12'. After molded cleaning patch assembly 10, 10' is cooled and removed from the mold, any flash material or excess swab material may be trimmed away. In another embodiment of the method, adhesive may be applied to the molded frame and/or swab that will secure the swab to the frame. In another embodiment, a solvent may be applied to the flat side of the frame to soften the elastopolymer sufficient to permit a direct bonding the fibers of the swab to the frame.

In a presently preferred method of using universal gun cleaning patch 10, center attachment bore 10 is threaded onto a rod or cable end (not shown) with cleaning swab 20 facing the cable. The other end of the rod or cable is inserted into the breech of the weapon and thence into the barrel until the cable passes out the muzzle end. The rod or cable and patch are then pulled through the barrel with a steady force. Patch assembly 10 may be replaced as needed and the procedure repeated until the bore is clean.

In a presently preferred method of using universal gun cleaning patch 10', a quick-connect stem 32 having a ball head 34 is installed into tapered center attachment bore 16' via the larger diameter end. The ball head 34 may include a transverse flat 35 at its junction with the stem 32. Fingers 30 are resiliently spread apart by, and to permit passage of, ball head 34 which is then retained by inward deformation of fingers 30 in response to engagement of ball head 34 with fingers 30 and axial force 36 applied to quick-disconnect stem 32. The distal end of the fingers 30 may abut the base of the ball head adjacent to the junction of the ball head and the stem. A cleaning rod or cable (not shown) may be screwed into threaded recess 38. The other end of the rod or cable is inserted into the breech or muzzle end of the weapon and thence into the barrel until the cable passes out the opposite end. The rod or cable 40 and patch assembly 10,10' are then pulled through the barrel 50 with a steady force. As the legs 18, 18' of the frame 12, 12' fold in the axial direction of the hub 14, 14', the fingers 30' of the hub 14' deflect further inward toward the stem 32 and further resist inadvertent detachment of the patch from the cable or rod. When the ball head 34 includes the optional transverse flat 35, the distal ends of the fingers 18, 18' engage the flat and further resist inadvertent separation of the patch from the cable during cleaning operations. Patch 10' may be replaced as needed and the procedure repeated until the bore is clean.

Persons skilled in the art would recognize that any of the disclosed hub arrangements may be utilized with either straight or spirally-curved legs in accordance with the present invention.

From the foregoing description, it will be apparent that there has been provided an improved apparatus for cleaning the bores of weapons. Although the disclosed embodiments have been disclosed for illustrative purposes, those skilled in the art will appreciate that various modifications, additions and substitutions are possible, without departing from the scope and spirit as disclosed in the accompanying claims. It will be further understood that the above description of embodiments is by way of illustration only and is not to be construed as limiting the claims to any single embodiment.

What is claimed is:

1. A gun cleaning patch assembly for cleaning the internal bore of a barrel of a firearm, comprising:

a) a support frame comprising a hub adapted to engage an end of an elongated member, said hub having a longitudinal axis, and a plurality of legs extending outward from said hub and having free ends, said legs forming a circumferential pattern and being resiliently flexible in a direction parallel to said longitudinal axis; and b) a swab affixed to said support frame, said swab extending circumferentially across the entire circumferential pattern of the plurality of legs.

2. A gun cleaning patch assembly in accordance with claim 1 wherein said support frame is formed of a thermoplastic.

3. A gun cleaning patch assembly in accordance with claim 1 wherein said support frame is formed of nylon.

4. A gun cleaning patch assembly in accordance with claim 1 wherein said hub includes a center attachment bore.

5. A gun cleaning patch assembly in accordance with claim 4 wherein said center attachment bore is threaded.

6. A gun cleaning patch assembly in accordance with claim 4 wherein said center attachment bore is self-threading to a fitting at the end of the elongated member.

7. A gun cleaning patch assembly in accordance with claim 1 wherein said hub is comprised of a plurality of fingers adapted to engage a fitting at the end of the elongated member.

8. A gun cleaning patch assembly in accordance with claim 7 wherein said plurality of fingers define a tapered bore.

9. A gun cleaning patch assembly in accordance with claim 1 wherein said plurality of legs extend radially straight from said hub.

10. A gun cleaning patch assembly in accordance with claim 1 wherein said plurality of legs extend outward from said hub in a flat spiral.

11. A gun cleaning patch assembly in accordance with claim 1 wherein said swab comprises fabric selected from the group consisting of natural fibers, synthetic fibers, laminates of said fibers, and combinations thereof.

12. A gun cleaning patch assembly in accordance with claim 1 wherein said swab further comprises stiff filaments selected from the group consisting of synthetic fibers, plastic and metal.

13. A gun cleaning patch assembly in accordance with claim 1 wherein said swab further comprises a mesh selected from the group consisting of synthetic fibers, plastic and metal.

14. A gun cleaning patch assembly in accordance with claim 1 wherein said plurality of legs comprises at least six legs.

15. A gun cleaning patch assembly in accordance with claim 1 wherein said plurality of legs extend radially outward from the longitudinal axis a distance greater than a diameter of the bore of a firearm to be cleaned.

16. A gun cleaning patch assembly in accordance with claim 1 wherein said patch assembly is formed by overmolding of said support frame onto said swab.

17. A gun cleaning patch assembly in accordance with claim 2 wherein said center attachment bore is tapered and wherein said hub further comprises a plurality of longitudinal fingers arrayed symmetrically about the smaller-diameter end of said tapered center attachment bore.

18. A gun cleaning patch assembly in accordance with claim 1 wherein said assembly is adapted and configured to clean the barrels of firearms having a plurality of differing bore diameters.

19. A method for cleaning the barrel of a firearm, comprising the steps of:

a) providing a gun cleaning patch assembly having a support frame including a hub, a plurality of legs extending outward from said hub and forming a circumferential pattern, said legs having free ends and being resiliently deformable in a direction parallel to an axis of said barrel, and a swab permanently attached to said support frame;

b) attaching said gun cleaning patch assembly to a first end of an elongated member;

c) passing a second end of said elongated through said barrel;

d) drawing said gun cleaning patch assembly into said barrel wherein said plurality of radial legs and said swab are folded in an axial direction of said barrel; and e) drawing said first end and said folded universal gun cleaning patch assembly through said barrel.

20. The method of cleaning the barrel of a firearm of claim 19, wherein said hub further comprises a plurality of longitudinal fingers and wherein said fingers engage a fitting at the first end of the elongated member.

* * * * *